United States Patent [19]

Beecher

[11] 4,334,455

[45] Jun. 15, 1982

[54] TONE IMPROVING DEVICE FOR A STRINGED MUSICAL INSTRUMENT

[76] Inventor: Jonathan Beecher, 95 Old Rd., Headington, Oxford, England

[21] Appl. No.: 166,375

[22] Filed: Jul. 7, 1980

[51] Int. Cl.[3] ..... G10D 3/12

[52] U.S. Cl. ..... 84/302; 84/297 R; 84/299

[58] Field of Search ..... 84/274, 278–280, 84/297 R, 299–302

[56] References Cited

U.S. PATENT DOCUMENTS

| | | | |
|---|---|---|---|
| 440,882 | 11/1890 | Lorang et al. | 84/297 R |
| 576,606 | 2/1897 | Nichols | 84/300 |
| 1,182,687 | 5/1916 | Kershner | 84/300 |
| 4,171,660 | 10/1979 | Kingsbury | 84/297 R |

*Primary Examiner*—Lawrence R. Franklin
*Attorney, Agent, or Firm*—Young & Thompson

[57] ABSTRACT

A stringed musical instrument, of the type in which the strings extend over a bridge which rests on the table of the instrument and are secured to a tailpiece, is provided with a tone improving device for maximising the tone production whatever strings are fitted to the instrument. The device is clamped to the table of the instrument and incorporates a nut to which the tailgut is attached. The nut is mounted on a threaded cylindrical member so as to be movable upwardly or downwardly on rotation of the member to modify the angle between the table and the part of the strings extending from the bridge to the tailpiece thereby to control the force exerted by the bridge on the table due to the tension in the strings without substantially varying the tension in the strings.

7 Claims, 9 Drawing Figures

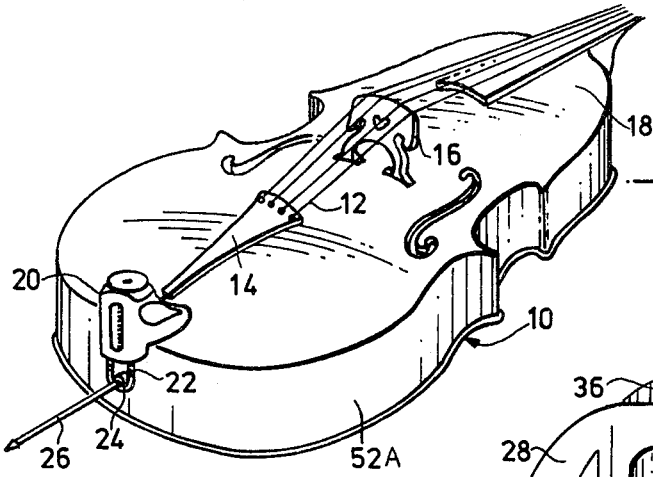
-FIG.1-
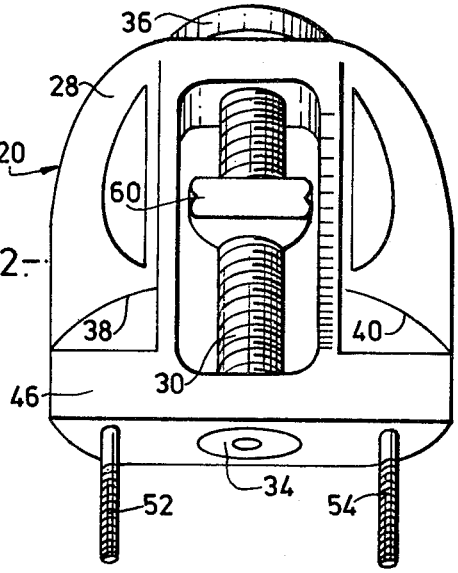
-FIG.2-
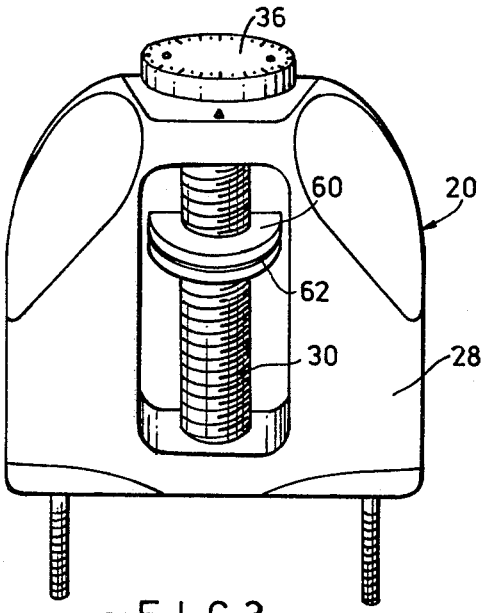
-FIG.3-
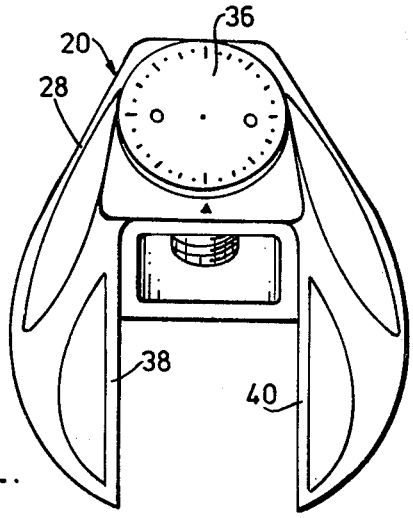
-FIG.4-

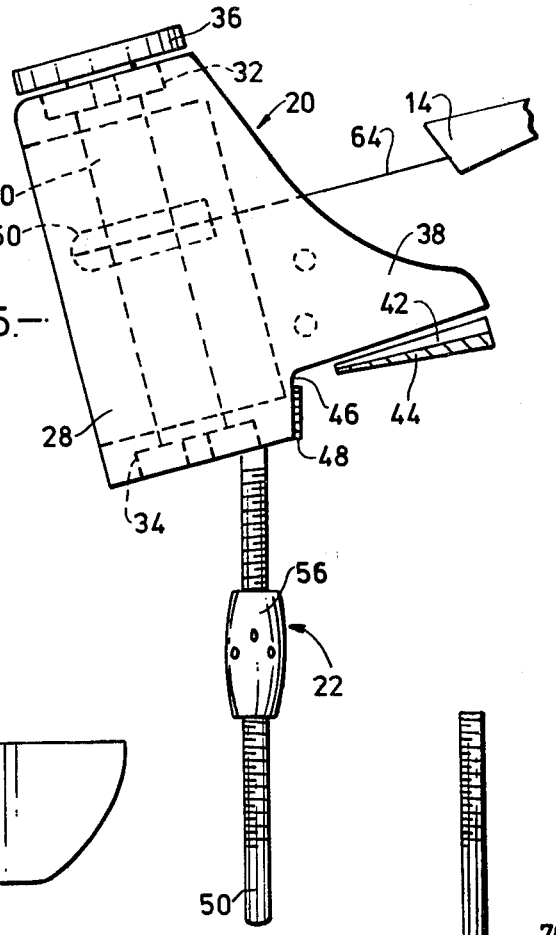
-FIG.5.-
-FIG.6.-
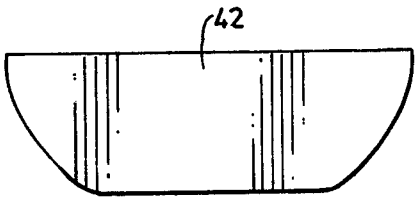
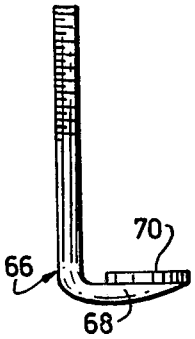
-FIG.8.-
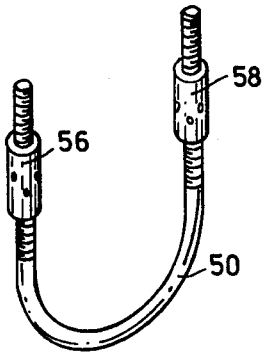
-FIG.7.-
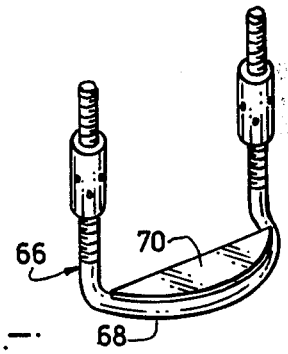
-FIG.9.-

TONE IMPROVING DEVICE FOR A STRINGED MUSICAL INSTRUMENT

BACKGROUND OF THE INVENTION

This invention relates to a tone improving device for a stringed musical instrument. The invention is applicable to stringed instruments of the type in which the strings extend over a bridge which rests on the table of the instrument and are secured to a tailpiece.

It has been found that, with stringed musical instruments of the type to which the invention relates, the tone produced by the instrument is adversely affected if an excessive downward force is exerted by the bridge. The instrument tends to sound "gagged". This is believed to be because the table of the instrument is unduly pre-stressed so that it cannot vibrate satisfactorily. The problem is particularly acute in cases where an instrument which was originally intended to be fitted with gut strings is restrung using wire strings of the substantially higher tensions used with the latter.

It is an object of the invention to provide a tone improving device for a stringed musical instrument of the type to which the invention relates, which device can be adjusted so as to optimise the downward force exerted by the strings on the bridge so that maximum tone production and projection from the instrument can be achieved whatever the type of strings fitted to the instrument.

SUMMARY OF THE INVENTION

According to the invention, a tone improving device, for a stringed musical instrument of the above-mentioned type, comprises adjustable means adapted to modify the angle between the table of the instrument and the part of the strings extending from the bridge to the tailpiece thereby to control the force exerted by the bridge on the table of the instrument due to the tension in the strings without substantially varying the tension in the strings.

BRIEF DESCRIPTION OF THE DRAWINGS

An embodiment of the invention will now be described, by way of example, with reference to the accompanying drawings, in which:

FIG. 1 is a perspective view of part of a 'cello fitted with a tone improving device in accordance with the invention.

FIGS. 2, 3 and 4 are front, rear and top views of the tone improving device shown in FIG. 1, FIG. 5 is a side view of the device shown in FIG. 1, fitted with a clamp for connection to the endpin of the 'cello shown in FIG. 1, FIG. 6 is a plan view of a wedge for the clamp shown in FIG. 5, FIG. 7 is a perspective view of the clamp shown in FIG. 5, and FIGS. 8 and 9 are side and perspective views respectively of an alternative form of clamp.

DETAILED DESCRIPTION OF THE DRAWINGS

Referring to FIG. 1, a 'cello 10 has strings 12 attached to a tailpiece 14 and running over a bridge 16 which rests on the table 18 thereof. A tone improving device 20, in accordance with the invention, is clamped, with one surface engaging with the table 18, by means of a clamp 22 which engages around a conventional endpin

24 in the form of a tube through which the 'cello spike 26 projects. The tailpiece 14 is attached to the device 20 as will be explained hereinafter.

Referring to FIGS. 2 to 5, the tone improving device 20 comprises a metal housing 28 containing a threaded cylindrical member 30 journaled in bearings 32 and 34 in the top and bottom of the housing 28 and carrying a control knob 36 on its upper end.

The device 20 includes two forwardly projecting limbs 38 and 40 which, when the device is fitted to a musical instrument, engage with a metal wedge 42 (FIGS. 5 and 6) having a cork lining 44 which rests on the table 18 of the instrument. A step 46 is formed on the housing 28 behind the limbs 38 and 40 and carries another cork lining 48 which engages with the instrument ribs 52A (FIG. 1). The clamp 22 projects from the bottom of the housing 28 behind the step 46. The clamp 22 comprises a generally U-shaped portion 50, having a respective clockwise thread on each of its two limbs, and corresponding members 52 and 54, having anticlockwise threads thereon, projecting from the base of the housing 28 and coupled to the limbs of the U-shaped member 50 by threaded sleeve couplings 56 and 58. Since the threads on the U-shaped member 50 and on the members 52 and 54 are of opposite sense, rotation of the sleeve couplings 56 and 58 varies the distance between the U-shaped member 50 and the base of the housing, thereby permitting the clamp to be tightened when the U-shaped member engages round the endpin 24 of the 'cello 10 (FIG. 1).

A nut 60 is threaded on the cylindrical member 30 and has a groove 62 extending round part of its periphery for reception of a tailgut or tailpiece fastener, in the form of a wire 64, connected to the tailpiece 14 of the 'cello 10. The nut 60 is non-circular-symmetric in the plane of the groove 62, the side thereof remote from the tailpiece 14 being semi-circular while the side nearest the tailpiece 14 is rectangular. With this arrangement, when the wire 64 is under tension, it inhibits rotation of the nut 60 when the knob 36 is turned to rotate the cylindrical member 30.

In use, when the device 20 is fitted to an instrument such as the 'cello 10, the clamp 22 is adjusted so that the device 20 is held firmly in position without exerting undue force on the instrument. The strings 12 of the instrument are then tightened until the instrument is in tune. Thereafter, the knob 36 is rotated to vary the positon of the nut 60 on the cylindrical member 30 and thereby to vary the height of the point of attachment of the tailstring 64 above the table 18. The effect of this is to vary the downward force which the strings 12 exert on the bridge 16 and the force exerted by the bridge 16 on the table 18.

FIGS. 8 and 9 illustrate an alternative form of clamp for use with an instrument not having a suitable endpin for engagement by the U-shaped member 50 as clamp 22. The clamp shown in FIGS. 8 and 9 has a modified U-shaped member 66, the curved portion 68 of which is bent round out of the plane of the U-shape so as to extend at right angles to the limbs thereof. A pad 70 is provided on the upper surface of the curved portion 68 for engagement with the back of the instrument. Thus, the modified clamp shown in FIGS. 8 and 9 engages between the table and the back of the instrument instead of between the table and the end pin.

If the device is fitted to a violin, a chin rest will be mounted above the device 20 and the tailpiece 14. In order to enable the chin rest to be at the normal height above the table of the instrument, the tailpiece 14 may be longitudinally curved so as to have a concave upper surface providing a concavity into which a porton of the chin rest may extend. In this case the tailpiece would need to be made of metal or reinforced plastics material.

I claim:

1. A tone improving device for a stringed musical instrument of the type in which the strings extend over a bridge resting on the table of the instrument and are secured to a tailpiece, comprising adjustable means adapted to modify the angle between the table of the instrument and the part of the strings extending from the bridge to the tailpiece thereby to control the force exerted by the bridge on the table of the instrument due to the tension in the strings without substantially varying the tension in the strings, wherein the angle modifying means comprises spacer means adapted to engage with the edge of the table adjacent to the tailpiece and to support the tailgut attached to the tailpiece of the instrument at a distance above the table which may be varied in accordance with the force required to be exerted by the bridge on the table.

2. A tone improving device according to claim 1, wherein the angle modifying means comprises a rotatable cylindrical member having a screw-threaded portion mounted on clamping means including a clamping surface adapted to engage with the table of the instrument, the axis of the cylindrical member being substantially perpendicular to the said clamping surface.

3. A tone improving device according to claim 2, including a nut on said screw-threaded portion and having means for attachment of the tailgut of the instrument thereto.

4. A tone improving device according to claim 2, wherein the external periphery of the nut is not symmetrical about the axis of the hole therein, said external periphery having a groove for reception of the tailgut extending round part of the periphery thereof.

5. A tone improving device according to claim 2, in which a knob is attached to the end of the cylindrical member remote from the clamping surface.

6. A stringed musical instrument of the type in which the strings extend over a bridge resting on the table of the instrument and are secured to a tailpiece, fitted with a tone improving device according to claim 2, the tailgut attached to the tailpiece of the instrument engaging in a groove in a nut on said screw-threaded portion of the cylindrical member.

7. A stringed musical instrument of the type in which the strings extend over a bridge resting on the table of the instrument and are secured to a tailpiece, fitted with a tone improving device according to claim 1.

* * * * *